US005249333A

United States Patent [19]

Wörwag

[11] Patent Number: 5,249,333

[45] Date of Patent: Oct. 5, 1993

[54] VACUUM CLEANING TOOL

[75] Inventor: Peter Wörwag, Romanshorn, Switzerland

[73] Assignee: Firma Fedag, Romanshorn, Switzerland

[21] Appl. No.: 839,325

[22] Filed: Feb. 19, 1992

[30] Foreign Application Priority Data

Feb. 21, 1991 [DE] Fed. Rep. of Germany ..... 4105336

[51] Int. Cl.[5] ..... A47L 5/30

[52] U.S. Cl. ..... 15/387

[58] Field of Search ..... 15/387

[56] References Cited

U.S. PATENT DOCUMENTS 983,988 2/1911 Foster et al. ..... 15/387 X 2,683,276 7/1954 Olsen ..... 15/387

2,777,152 1/1957 Cosentino ..... 15/387

FOREIGN PATENT DOCUMENTS 2387015 12/1978 France ..... 15/387

*Primary Examiner*—Chris K. Moore

*Attorney, Agent, or Firm*—Robert W. Becker & Associates

[57] ABSTRACT

A vacuum cleaning tool for a vacuum cleaner, including an intake opening and a brush roller that is disposed in the intake opening and is rotatably driven by an air turbine that in turn is driven by an intake air flow. To obtain a high torque at the brush roller even when the intake air stream fluctuates, the air turbine is embodied as a flow-through turbine having at least one ring-like blade arrangement, between the blades of which are formed axially delimited flow paths for radially receiving the intake air flow and guiding same into the center of the blade arrangement, and for radially discharging the intake air flow out of this inner space.

7 Claims, 2 Drawing Sheets

VACUUM CLEANING TOOL

BACKGROUND OF THE INVENTION

The present invention relates to a vacuum cleaning tool for a vacuum cleaner, including a suction or intake opening and a brush roller that is disposed in the intake opening and is rotatably driven by an air turbine that in turn is driven by an intake air flow.

During the vacuum cleaning of textile floor coverings and smooth floor surfaces, the flow energy of the inflowing intake air stream is frequently inadequate for loosening dirt particles that adhere to the surface that is to be cleaned. Therefore, especially when cleaning textile floor coverings, a rotatably driven brush roller is provided in the intake opening. With respect to a textile floor covering, the rotating brush roller also serves to again raise nap or pile that has been matted or otherwise pressed down, as a result of which in addition to achieving an improved access to the dirt particles that are deposited in the base of the carpet nap, an improved visual effect is also achieved.

The drive for the rotating brush roller is effected via an air turbine that in turn is driven by the intake air stream that is flowing through the vacuum cleaning tool. By means of a belt drive, the rotation of the turbine wheel is transferred to the rotatably mounted brush roller, accompanied by simultaneous reduction of the speed. The blade arrangement of the turbine wheel is closed, in other words, adjacent blades define a closed space that is open only toward the flow-in direction of the intake air stream, but is closed relative to the axis of rotation of the turbine. The intake air stream that enters is deflected in the base of the blades and undergoes turbulence in the turbine chamber. Due to different floor surfaces such as smooth floors or textile floor coverings having different nap heights and densities, and due to the back and forth operating movements as well as a restriction of the intake air stream that frequently occurs from the dust filter getting loaded with dirt, the intake air stream that drives the turbine wheel, and hence also the torque and speed of the brush roller, fluctuate greatly.

It is therefore an object of the present invention to provide a vacuum cleaning tool of the aforementioned general type that provides an adequately high torque and speed at the brush roller, even when fluctuations of the intake air stream are encountered.

BRIEF DESCRIPTION OF THE DRAWINGS

This object, and other objects and advantages of the present invention, will appear more clearly from the following specification in conjunction with the accompanying schematic drawings, in which.

SUMMARY OF THE INVENTION

Figure 1:
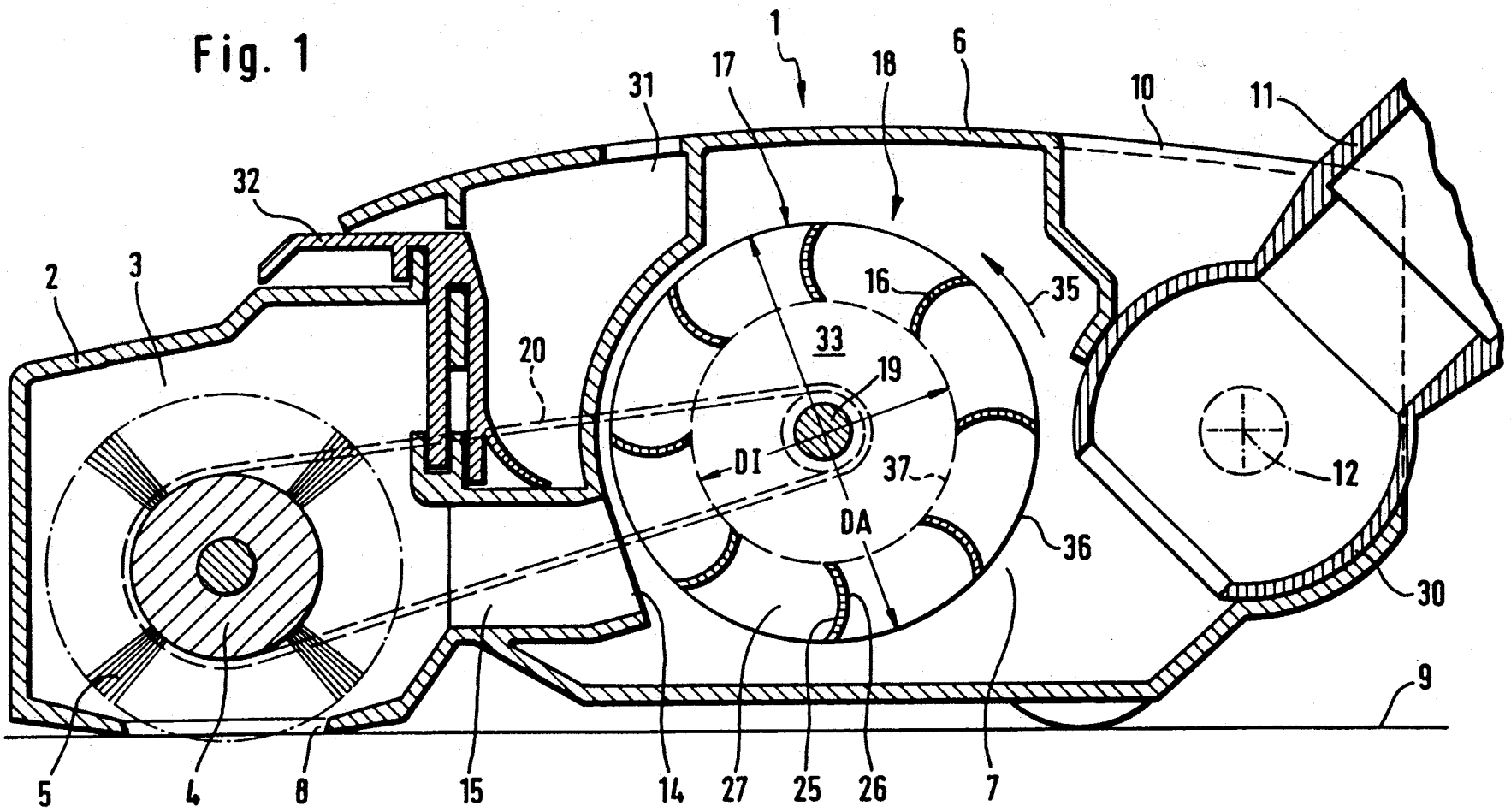
FIG. 1 is a longitudinal cross-sectional view through one exemplary embodiment of the inventive vacuum cleaning tool.

The vacuum cleaning tool of the present invention is characterized primarily in that the air turbine is a flow-through turbine having at least one ring-like blade arrangement, between the blades of which are formed axially delimited flow paths for radially receiving the intake air flow and guiding the same into a center space of the blade arrangement, and for radially discharging the intake air flow out of the center space.

As a consequence of the inventive blade arrangement, which is open relative to the axis of rotation of the air turbine, flow paths are provided that permit radial entry of the intake air stream into an inner space that is disposed in the center of the ring-like blade arrangement. The intake air stream that is directed onto the air turbine therefore first enters the inner space via the flow paths, whereupon the intake air stream again exits the inner space through the blade ring via the flow paths and into the turbine chamber. Thus, the intake air stream passes the blade ring twice and essentially without a forced change in direction. Despite the very limited spatial conditions and without an increase in size, due to the described flow path that is free of deflections an adequately high torque and adequately high speed are provided for loosening dirt particles that adhere to a floor surface and/or for raising the nap of a textile floor covering.

Further specific features of the present invention will be described in detail subsequently.

DESCRIPTION OF THE PREFERRED EMBODIMENTS

Referring now to the drawings in detail, the illustrated vacuum cleaning tool 1 has a housing 6 with a central turbine chamber 7. Disposed in the turbine chamber 7 is an air turbine 18, the axis of rotation 19 of which is disposed at right angles to the longitudinal central axis 13 (FIG. 2) of the vacuum cleaning tool 1. As viewed transverse to the longitudinal central axis 13, the air turbine 18 is disposed approximately in the middle of the housing 6, i.e. in the turbine chamber 7.

As seen in the direction of the longitudinal central axis, a brush chamber 3, which is provided in the forward housing section 2, is disposed in front of the turbine chamber 7. Disposed in the brush chamber 3 is a brush roller 4, the axis of rotation of which extends at right angles to the longitudinal central axis 13 of the vacuum cleaning tool 1. The bristles 5 of the brush roller 4 project through the suction or intake opening 8, which faces the floor 9. The intake opening 8 extends transverse to the longitudinal central axis and over the entire width of the brush chamber 3, in other words over the entire width of the vacuum cleaning tool 1.

Figure 2:
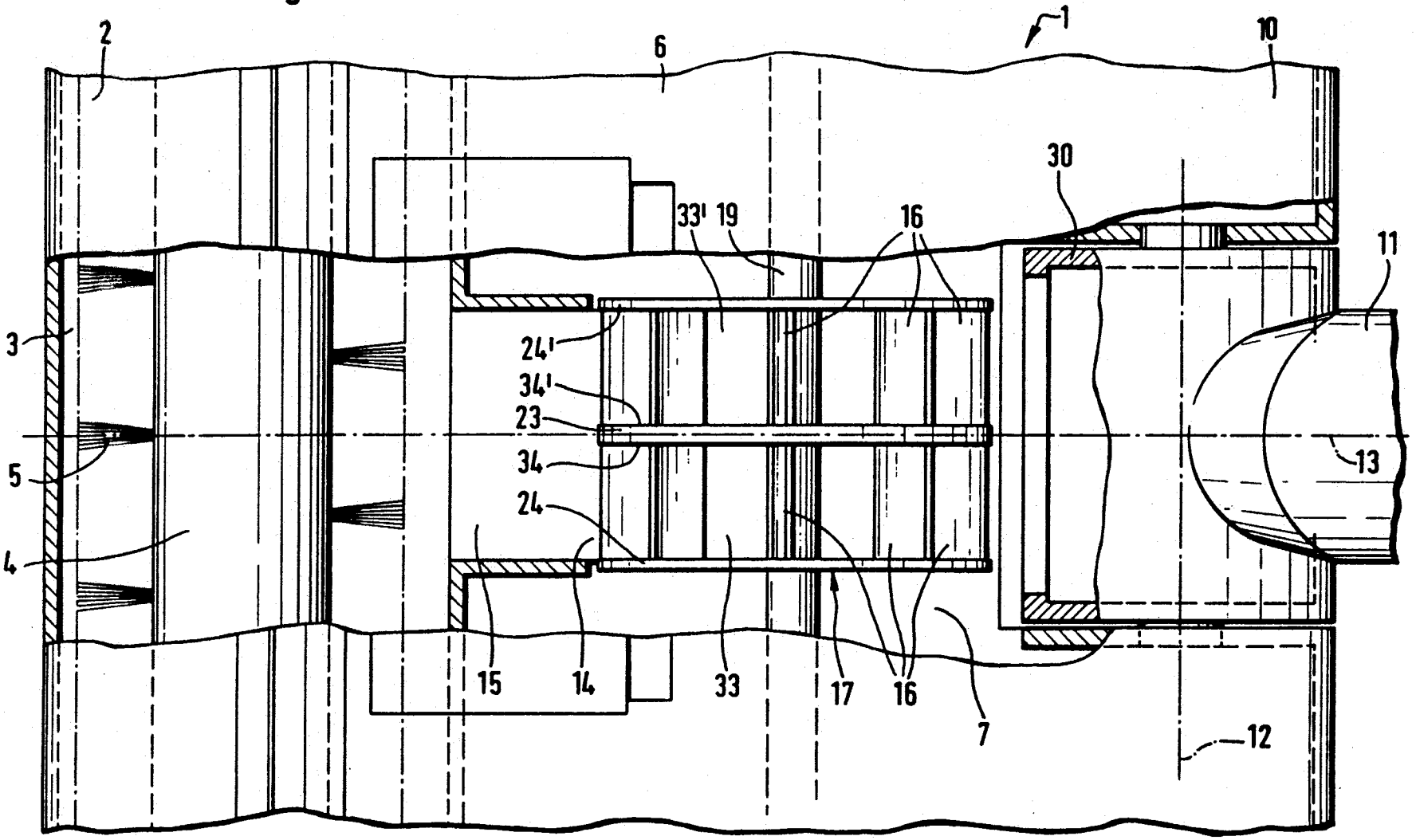
FIG. 2 is a partially cross-sectioned view from the top of part of the vacuum cleaning tool of FIG. 1.

Leading from the brush chamber 3 to the turbine chamber 7 is a feed channel 15. This feed channel 15 is disposed essentially approximately tangential relative to the turbine wheel 17 of the air turbine 18; the mouth 14 of the feed channel 15 is bent or angled slightly in a direction toward the axis of rotation 19, so that the exiting air stream is directed approximately radially relative to the axis of rotation 19. As shown in FIG. 2, the width of the feed channel 15 corresponds to the axial width of the turbine wheel 17.

The vacuum cleaning tool 1 is connected via a connector 11 in a non-illustrated manner to a vacuum hose of a vacuum cleaner. The connector 11 has a cylindrical pivot head 30 that on that side of the turbine chamber 7 that is remote from the brush chamber 3, in the rear section 10 of the housing 6, is mounted in such a way as to be pivotable in the housing 6 about a pivot axis 12 that is disposed transverse to the longitudinal central axis 13. The connector 11 opens out into the turbine chamber 7 and forms the discharge channel for the suction or intake air flow. The intake air flow flows through the intake opening 8 into the brush chamber 3, is conveyed via the feed channel 15 into the turbine chamber 7, and is directed by the mouth 14 onto the turbine wheel 17. In this manner, the intake air flow or stream drives the turbine wheel 17, and is then discharged from the turbine chamber 7 via the connector 11 to the vacuum cleaner. By means of a belt 20, the air turbine 18 drives the brush roller 4 in the brush chamber 3.

To be able to influence the intake air flow that enters the turbine chamber 7, there is provided in the upper side of the housing 6, adjacent to the forward housing section 2, a second air opening 31, the effective flow-through cross-section of which is adjustable via a slide mechanism 32 in a non-illustrated manner. When the secondary air opening 31 is opened, a secondary air flow enters the turbine chamber 7 parallel to the intake air flow that enters via the feed channel 15; this secondary air flow acts upon the turbine wheel 17.

To achieve greater drive power, the air turbine 18 is embodied as a so-called flow-through turbine. The turbine wheel 17 comprises a central wheel disk 23 via which the air turbine is rotatably held on the axis or shaft 19. Provided on the two axial side surfaces 34, 34' of the wheel disk 23 is a blade arrangement 16, which comprises blades that are disposed concentric to the axis of rotation 19 and are arranged in the manner of a ring. The outer diameter DA of the blade ring corresponds to the outer diameter of the wheel disk 23; the inner diameter DI of the blade ring defines an inner space 33 and 33'. The axially outer side of each blade ring 16 that is remote from the wheel disk 23 is closed off by a cover ring 24 or 24' that fixedly interconnects the axial ends of the individual blades. Furthermore, in this manner a flow path is defined between the front surface 25 and the rear surface 26 of adjacent blades; this flow path is axially delimited by the wheel disk 23 and one of the cover rings 24 or 24'.

As can be seen in particular in FIG. 2, the turbine wheel 17 is symmetrical relative to the wheel disk 23; the turbine wheel is preferably made as a single piece with the wheel disk 23, the blade arrangements 16, and the cover rings 24 and 24', and is in particular made of plastic.

The intake air stream that is directed out of the feed channel 15 via the mouth 14 first enters the inner space 33 of the air turbine 18 from the outer line 36 of the turbine wheel 17 via the flow paths 27. As the air flow passes from the outer line 36 to t he inner line 37 of the blade ring, the turbine wheel 17 is driven in the direction of the arrow 35. The intake air flow now passes from the inner line 37 via the flow paths 27 to the outer line 36 of the blade ring 16 and into the turbine chamber 7, whereby the turbine wheel 17 is further driven in the direction of the arrow 35. Only now does the intake air stream flow out of the turbine chamber 7 via the connector 11.

The inner space 33 of the blade ring is advantageously closed off axially, with the cover ring 24, 24' being embodied as a cover disk. Such a cover disk can advantageously additionally be used for mounting the turbine wheel on the shaft 19.

The present invention is, of course, in no way restricted to the specific disclosure of the specification and drawings, but also encompasses any modifications within the scope of the appended claims.

What I claim is:

1. In a vacuum cleaning tool for a vacuum cleaner, including a housing having an intake opening, outlet means, and a turbine chamber, with a brush roller being disposed in said intake opening and being rotatably driven by an air turbine that is disposed in said turbine chamber and is itself rotatably driven by an intake air flow received from a feed channel that communicates with said intake opening, the improvement wherein:

said air turbine has at least one ring-like blade arrangement that has an open central inner space that is free of blades, whereby between blades of said at least one blade arrangement axially delimited flow paths are formed; and said feed channel has a mouth portion for directing said intake air flow onto said at least one blade arrangement essentially radially relative to an axis of rotation of said air turbine, whereby said flow paths between said blades radially guide said intake air flow into said open central inner space and radially discharge said intake air flow out of said open central inner space to said outlet means of said housing.

2. A vacuum cleaning tool according to claim 1, in which said air turbine includes a central wheel disk, with each of two axial side surfaces of said wheel disk supporting a respective one of said blade arrangements.

3. A vacuum cleaning tool according to claim 2, in which a free axial side of each of said blade arrangements is provided with a cover ring.

4. A vacuum cleaning tool according to claim 1, in which said center space is axially closed off by a cover disk.

5. A vacuum cleaning tool according to claim 1, in which said axis of rotation of said air turbine extends parallel to an axis of rotation of said brush roller.

6. In a vacuum cleaning tool for a vacuum cleaner, including an intake opening and a brush roller that is disposed in said intake opening and is rotatably driven by an air turbine that in turn is driven by an intake air flow, the improvement wherein;

said air turbine is a flow-through turbine formed by a central wheel disk having tow oppositely facing axial side surfaces, each of which supports a ring-like blade arrangement that has an open central inner space that is free of blades, whereby between the blades of each of said blade arrangements axially delimited flow paths are formed for radially receiving said intake air flow and guiding same into said open central inner space of said blade arrangement, with said flow paths also serving for radially discharging said intake air flow back out of said inner space.

7. A vacuum cleaning tool according to claim 6, which includes a feed channel for said intake air flow, with said feed channel having a mouth portion for directing said intake air flow onto said blade arrangement approximately radially relative to an axis of rotation of turbine wheel of said air turbine.

* * * * *